US007163450B2

(12) United States Patent
Kawamura et al.

(10) Patent No.: US 7,163,450 B2
(45) Date of Patent: Jan. 16, 2007

(54) ABRASIVE PAD

(75) Inventors: Koichi Kawamura, Shizuoka-ken (JP); Morio Yagihara, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 184 days.

(21) Appl. No.: 10/810,657

(22) Filed: Mar. 29, 2004

(65) Prior Publication Data

US 2004/0198203 A1 Oct. 7, 2004

(30) Foreign Application Priority Data

Mar. 31, 2003 (JP) ..... 2003-095930

(51) Int. Cl.
*B24D 11/00* (2006.01)

(52) U.S. Cl. ..... 451/526; 451/533; 451/534

(58) Field of Classification Search ..... 451/41, 451/285, 287, 288, 526, 528, 530, 533, 532, 451/534; 51/298, 300
See application file for complete search history.

(56) References Cited

U.S. PATENT DOCUMENTS 6,117,000 A 9/2000 Anjur et al.
6,364,749 B1 4/2002 Walker
6,585,574 B1 * 7/2003 Lombardo et al. ..... 451/285
6,632,259 B1 * 10/2003 Weinstein et al. ..... 51/298
6,743,080 B1 * 6/2004 Truong ..... 451/56
6,884,156 B1 * 4/2005 Prasad et al. ..... 451/533
6,902,590 B1 * 6/2005 Weinstein et al. ..... 51/298
6,948,873 B1 * 9/2005 Policicchio et al. ..... 401/139

FOREIGN PATENT DOCUMENTS

EP 1 138 438 A1 10/2001
JP 2002-200554 A 7/2002

* cited by examiner

*Primary Examiner*—Eileen P. Morgan
(74) *Attorney, Agent, or Firm*—Sughrue Mion, PLLC

(57) ABSTRACT

The present invention provides an abrasive pad for abrading a surface to be abraded in the presence of an abrasive solution, which includes a hydrophobic polymer as a base material, and in which a graft-polymer chain having a hydrophilic group is introduced into the surface of the hydrophobic polymer. The hydrophilic group possessed by the graft-polymer chain is preferably a nonionic hydrophilic group selected from the group consisting of hydrophilic groups having an N-monoalkyl substituted structure and hydrophilic groups having an N-dialkyl substituted amide group. An amount of the hydrophilic graft-polymer to be introduced into the base material is preferably 10.0% to 150.0% in terms of graft ratio.

17 Claims, No Drawings

ABRASIVE PAD

CROSS-REFERENCE TO RELATED APPLICATION

This application claims priority under 35 USC 119 from Japanese Patent Application No. 2003-95930, the disclosure of which is incorporated by reference herein.

BACKGROUND OF THE INVENTION

1. Field of the Invention

The present invention relates to an abrasive pad preferably used for chemical-mechanical polishing (CMP) in order to make a mirror surface finish and to preferentially abrade a convex portion of irregularities on a surface of a working piece. The surface of the working piece is abraded by pressing the working piece against a rotating elastic pad, and allowing a relative motion while supplying an abrasive solution that contains processing abrasive grains or an abrasive solution that contains no abrasive grains.

2. Description of the Related Art

In order to realize multi-layer interconnection for producing a highly integrated semiconductor, it is necessary to completely flatten the surface of an insulated film. As typical technologies for this flattening method, an SOG (Spin-On-Glass) method, etchback method, lift-off method and the like have been investigated.

As regards the SOG method, which is a flattening method utilizing the fluidity of an SOG film, it is impossible to attain complete flattening by this method alone. The etchback method is a most widespread technique; however, a problem arises in that dust is generated by simultaneous etching of a resist and an insulated film and hence dust control is not easy. The lift-off method has a problem in that lift-off cannot be attained since stencil materials to be used are not thoroughly soluble at the time of lift-off, and therefore the method is still beyond practical use due to insufficient controllability and yield.

Under the above circumstances, a chemical-mechanical polishing method (CMP method) is recently attracting attention. In this method, the convex portion of irregularities on the surface of the working piece is preferentially abraded by pressing the working piece against a rotating elastic pad and allowing a relative motion, and is currently widely used due to simplicity of the process.

In recent years, a problem has arisen concerning surface defects, especially surface defects caused by minute irregularities associated with a pre-processing semiconductor wafer, relating to a term "nano-topology" and is a current issue. In order to cope with the problem, double-sided surface abrasion, a method of abrading substance surfaces while flowing an alkali, or the like are carried out.

Such a CMP method, however, poses problems of scratching, dust adhesion, and global flatness inferiority occurring on the surface of materials to be abraded. If dust adhesion and scratching occur on the surface of, for example, an intra-layer insulating film to be abraded, a stepping phenomenon or the like may occur when forming wiring of, for example, an Al or Cu type metal on the abraded layer in a subsequent step, possibly leading to reduced reliability such as deteriorated electro-migration durability. Also, loss of regenerative signals may be caused such as dropouts in abrasion of nonmagnetic base materials for HDDs (Hard Disk Drive). Scratching are thought to be caused by aggregated particles that have failed to disperse. Especially, an abrasive slurry produced by adopting alumina as abrasive particles and used for metal layer CMP has poor dispersibility and is unsatisfactory in preventing scratching. The cause of dust adhesion is not yet clearly understood. Generally, a hard abrasive pad is used to improve global flatness, but incidences of dust adhesion and scratching may easily occur, and hence is not considered to meet both of the two desired characteristics mentioned above.

In order to improve global flatness and reduce dust adhesion and scratching, several techniques have been proposed (see, for example, Japanese Patent Application National Publication (Laid-Open) No. 8-500622 and Japanese Patent Application Laid-Open (JP-A) No. 2000-34416). These techniques, however, have not attained both characteristics of dust adhesion/scratching and flatness.

In order to attain effective flattening by employing CMP or other abrasive methods, the transfer and dispersion of a slurry onto the surface to be abraded are important. When a large number of abrasive methods, in particular, abrasive methods requiring high rotational speed and pressure are employed, insufficient fluidity of the slurry contained in an abrasive pad may lead to a ununiformly abraded amount per hour, and thus resulting in inferior surface qualities of base materials or deteriorated quality of the abrasive pad. In view of the foregoing, various efforts have been made to improve the transfer of the slurry. For instance, Cook et al. have proposed use of a large- or small-sized flow pass to facilitate the transfer of the slurry to the entire surface area of a hard abrasive pad (see, for example, U.S. Pat. No. 5,489,233), and Shamouillian et al. disclose an abrasive pad that is designed to make an abrasive slurry more fluidic by providing a flow pass through at least a part of the abrasive pad (see, for example, U.S. Pat. No. 5,533,923). Breivogel et al. have also proposed an abrasive pad provided with holes arranged at regular intervals for conveying the slurry to the entire surface of the pad (see, for example, U.S. Pat. No. 5,554,064).

In spite of these attempts, excellent characteristics with respect to dust adhesion/scratching and flatness have not yet been attained. In order to achieve both of these desired characteristics, good wettability of the surface sufficient to make the slurry readily conveyed to the surface to be abraded, as well as hydrophilic passes to allow the slurry to be easily supplied to an inside of the abrasive pad should be ensured. However, a pad that attains these characteristics has not yet been developed.

SUMMARY OF THE INVENTION

In view of the above-described problems, it is an object of the present invention to provide an abrasive pad having reduced adhesion of dust to a surface of a material to be abraded, low levels of scratching and excellent flattening characteristics.

The present inventors have conducted intensive research and discovered that it is important to provide good wettability of the surface. This enables an abrasive solution to be conveyed to a surface to be abraded, and hydrophilic passes permitting the abrasive solution to be easily supplied to an inside of the abrasive pad. The inventors have also discovered that if a specific hydrophilic graft-polymer chain is introduced into the surface of a hydrophobic resin that constitutes a base material, both good surface wettability and excellent flow passes can be attained, and have thereby accomplished the present invention.

The present invention relates to an abrasive pad for abrading a surface to be abraded in the presence of an abrasive solution, which comprises a hydrophobic polymer constituting a base material, wherein a graft-polymer chain having a hydrophilic group is introduced into the surface of the hydrophobic polymer.

In the present invention, the hydrophilic group possessed by the graft-polymer chain is preferably a nonionic hydrophilic group selected from the group consisting of hydrophilic groups having an N-monoalkyl substituted structure and hydrophilic groups having an N-dialkyl substituted amide group.

An introducing amount of the hydrophilic graft-polymer into the surface of the base material is preferably 10.0% to 150.0% in terms of graft ratio.

As used herein, introducing of a hydrophilic graft-polymer chain into the surface of a base material of the abrasive pad according to the invention means that the main chain of the hydrophobic polymer constituting the base material is provided with a branched molecular structure in which a polymer chain having a hydrophilic group is directly bound in a branched state, wherein the graft-polymer chain having a hydrophilic group is bonded to the principal polymer constituting the hydrophobic base material only at its terminal. Therefore, the graft-polymer chain having a hydrophilic group exists in a one terminal-free state, namely in a less-constrained state and therefore has high mobility in water or in a hydrated condition. It is considered that high mobility of the hydrophilic graft-polymer chain portion enables high surface affinity and an internal water passage.

Thus, it is considered that such a hydrophilic polymer chain exists on the entire surface of the hydrophobic polymer constituting the base material, providing a phase separation structure having no affinity to the base material in the hydrophobic base material polymer, whereby a continuous hydrophilic region is secured on the surface of the base material. Also, an abrasive solution or abrasive particles contained therein are adsorbed to a large number of the hydrophilic groups present in the graft, and hence the abrasive solution is sufficiently supplied to the surface to be abraded. There is thus no fear that dust will adhere to the surface, and highly abrasive characteristics can be realized. Moreover, softness due to the structure of the elastic graft-polymer chain structure ensures that the abrasive solution or abrasive particles contained therein are sufficiently supplied to the surface to be abraded, and accordingly a high degree of flatness is attained and generation of scratching caused by locally strong stress with respect to the abrasive particles is suppressed.

DETAILED DESCRIPTION OF THE INVENTION

Hereinafter, the present invention will be explained in more detail.

The abrasive pad of the invention is used for the purpose of abrading a surface to be abraded in the presence of an abrasive solution, and the abrasive pad comprises a hydrophobic polymer that constitutes a base material, wherein a graft-polymer chain having a hydrophilic group has been introduced into the surface of the hydrophobic polymer.

Hydrophilic Graft-Polymer Chain

The hydrophilic graft-polymer chain relating to the invention has a hydrophilic group in its structure. This hydrophilic functional group improves affinity to water and has high mobility, and the functional group is necessary to ensure an adequate supply of an abrasive solution to a surface to be abraded. The functional group is particularly independent of a material to be abraded, and therefore, it does not need abilities such as chelating property with a metal.

Examples of the hydrophilic functional group (hydrophilic group) preferably usable in the invention include ionic or ionizable hydrophilic groups such as a sulfonic acid group, carboxylic acid group and amino group, and nonionic hydrophilic groups such as an amide group, N-substituted amide group and N,N-disubstituted amide. Among these groups, nonionic hydrophilic groups such as an N-substituted amide and an N,N-disubstituted amide are particularly preferable from the viewpoint of high hydrophilicity.

The effects of the invention are exerted by the structure in which the hydrophobic polymer that constitutes the base material is used as the principal polymer into which the hydrophilic graft-polymer chain is introduced. Even if the hydrophilic functional group is introduced into the hydrophobic polymer base material, high mobility and high hydrophilicity cannot be obtained and sufficient effects are not obtained if the hydrophilic functional group does not have a graft chain structure.

As used herein, the graft-polymer chain refers to a polymer or oligomer having a prescribed length or a macromonomer having a given molecular weight, that has at least one hydrophilic group in its molecule.

An introducing amount (graft ratio) of the graft-polymer chain sufficient to exert the effects of the invention is in the range of from 1 to 300%, and preferably in the range of from 10 to 150%, in terms of graft ratio.

The graft ratio, that is indicative of the amount of the graft-polymer chain bound to the hydrophobic polymer constituting the base material in the invention, is expressed by the following equation.

Graft ratio (%)=[(weight of a film after grafting−weight of a base material film)/(weight of a base material film)]×100

The molecular weight (Mw) of such a hydrophilic graft-polymer chain is in the range of from 500 to 5,000,000, preferably from 1,000 to 1,000,000, and more preferably from 2,000 to 500,000.

Method of Producing Abrasive Pad

Examples of a method of introducing the hydrophilic graft-polymer into the base material made of the hydrophobic polymer include (1) a method in which the hydrophilic polymer is bonded to the base material by means of chemical bonding; (2) a method in which a compound having a polymerizable double bond is caused to polymerize by making the base material act as the basic point to form a graft-polymer; and (3) a method in which a hydrophobic principal polymer having a hydrophilic graft chain is allowed to crosslink.

In the invention, although any of the above methods may be used, the former two methods will be detailed first.

(1) A Method in Which the Hydrophilic Polymer is Bonded to the Base Material by Means of Chemical Bonding:

First, the method in which hydrophilic polymer is bonded to the base material by means of chemical bonding is explained below.

In this method, a polymer having a functional group, that is reactive with the base material at its terminal or in the side chain, is used to cause a reaction with a functional group present at the surface of the base material to thereby permit the polymer to be grafted. Examples of the functional group that is reactive with the base material include a silane coupling group such as alkoxysilane, isocyanate group, amino group, hydroxyl group, carboxyl group, sulfonic acid group, phosphoric acid group, epoxy group, allyl group, methacryloyl group and acryloyl group, although any material may be used without any particular limitation insofar as it can react with the functional group present at the surface of the base material.

Examples of compounds particularly useful as the polymer having a reactive functional group at its terminal or in the side chain include hydrophilic polymers having a trialkoxysilyl group at the terminal, hydrophilic polymers having an amino group at the terminal, hydrophilic polymers having a carboxyl group at the terminal, hydrophilic polymers having an epoxy group at the terminal, and hydrophilic polymers having an isocyanate group at the terminal.

Specific examples of the hydrophilic polymer for use in the invention include a polyacrylic acid, polymethacrylic acid, polystyrenesulfonic acid, poly-2-acrylamide-2-methylpropanesulfonic acid, the salts thereof, polyacrylamide and polyvinylacetamide, although any material may be used insofar as it is hydrophilic.

Examples of the hydrophilic monomer preferably used for introducing a hydrophilic group include monomers having a nonionic hydrophilic functional group such as an N-substituted amide group and an N,N-disubstituted amide group. Examples of the hydrophilic polymer obtained by introducing these monomers include a poly-N-vinylacetamide, poly-N-vinylpyrrolidone and N,N-dimethylamide. These hydrophilic polymers may be preferably used in this method.

(2) A Method in Which a Compound Having a Polymerizable Double Bond is Caused to Polymerize by Making the Base Material Act as the Basic Point to Form a Graft-Polymer:

The method in which a compound having a polymerizable double bond is caused to polymerize by making the base material function as the basic point to thereby form a graft-polymer is generally referred to as "surface graft-polymerization". As the surface graft-polymerization method used to implement the invention, any of the known methods described in literature may be used. For example, an optical graft-polymerization method and plasma irradiation graft-polymerization method are described as the surface graft-polymerization method in New Polymer Experimental Science 10, edited by Polymer Society, 1994, published by Kyoritsu Shuppan Co., Ltd., p.135. Also, a graft-polymerization method performed by applying radiation such as y-rays and electron rays is described in Adsorption Technologies Handbook, NTS K.K., supervised by Takeuchi, issued in February 1999, p.203, p.695. As specific optical graft-polymerization method, the methods described in JP-A Nos. 63-92658, 10-296895 and 11-119413 may be used. As the plasma irradiation graft-polymerization method and radiation irradiation graft-polymerization method, the methods described in, for example, the above literature and Y. Ikeda et al., "Macromolecules", Vol. 19, page 1804 (1986) may also be used.

In more detail, the graft-polymer can be introduced by treating the surface of a polymer such as polyethylene terephthalate (PET), using plasma or electron beams to generate radicals, followed by causing a reaction with the activated surface with a monomer that has a hydrophilic functional group.

Description will now be given of the radiation graft method for use as an exemplary grafting method. However, the grafting method relating to the invention is not limited to this method.

A monomer grafting method performed using electron beams as the radiation is explained below. First, accelerated electron beams are irradiated to a base material film made of a hydrophobic polymer at a dosage of 1 to 5 Mrad. The electron beams irradiated trigger generation of radicals on the main chain of the polymer that constitutes the base material. Polymerization of a monomer is thus effected through utilizing these radicals as a basic point. Specifically, the generated radicals contact with a hydrophilic monomer such as acrylic acid to thereby proceed a grafting reaction. Graft-polymerization is initiated at an active point on the surface of the base material film as a starting point, and it progresses with the monomer diffusing, thus enabling growth of the graft chain.

Because the applied electron beams are not interfered by the presence of the base material thereby penetrating deeply into the inside, radicals are generated also at the surface facing a void inside of the base material. Hence, a graft chain grows via these radicals as starting points in case where a porous sheet, a fiber-made sheet such as fabric and non-woven fabric are used. Thus, a graft-polymer chain having a hydrophilic group can be introduced into the inside of the porous substance void facing inside the base material or the surface of the fiber-type hydrophobic polymer facing inside, as occurred at the surface of the base material.

The grafting amount (graft ratio) of the polymer bonded to the base material is expressed by the following equation.

Graft ratio (%)=[(weight of a film after grafting−weight of a base material film)/(weight of a base material film)]×100

This graft ratio may vary depending on the material of the principal polymer. The graft ratio may fluctuate depending on the irradiation dose and the concentration of the monomer to be supplied for grafting. Therefore, it is possible to adjust a desirable graft ratio by controlling the irradiation dose and the concentration of the monomer. The preferable graft ratio in the invention is in the range of from 1 to 300%, preferably from 10 to 150%, and more preferably from 20 to 80%.

The effects of the invention can be considerably exerted when the graft ratio falls within the above range.

The compound having a hydrophilic group, that is used in the method in which the compound having a polymerizable double bond is caused to polymerize by making the base material act as a basic point to form a graft-polymer, may be any of a hydrophilic polymer, hydrophilic oligomer and hydrophilic monomer insofar as it has a double bond in its molecule, and any of these compounds may be used. A particularly useful compound is a hydrophilic monomer.

Examples of the hydrophilic monomer usable in invention include monomers having a positive charge, such as ammonium and phosphonium; or monomers containing an acid group having a negative charge or an acid group dissociable as a negative charge ion, such as a sulfonic acid group, carboxyl group, phosphoric acid group and phosphonic acid group; and hydrophilic monomers having a nonionic group, such as a hydroxyl group, amide group, sulfonamide group, alkoxy group and cyano group. Any of these monomers may be preferably used. Particularly preferable hydrophilic monomers are monomers having nonionic hydrophilic groups, such as an N-substituted amide and an N,N-disubstituted amide.

In the invention, as the particularly useful hydrophilic monomer, the following monomers may be listed. For example, a (meth)acrylic acid or its alkali metal salt and amine salt, itaconic acid or its alkali metal salt and amine salt, allylamine or its halogenated hydroacid salt, 3-vinylpropionic acid or its alkali metal salt and amine salt, vinylsulfonic acid or its alkali salt and amine salt, styrenesulfonic acid or its alkali metal salt and amine salt, 2-sulfoethylene(meth)acrylate, 3-sulfopropylene(meth)acrylate or its alkali metal salt and amine salt, 2-acrylamide-2-methylpropanesulfonic acid or its alkali metal salt and amine salt, acid phosphooxypolyoxyethylene glycol mono(meth) acrylate or its salt, 2-dimethylaminoethyl(meth)acrylate or its halogenated hydroacid salt, 3-trimethylammoniumpropyl (meth)acrylate, 3-trimethylammoniumpropyl(meth)acrylamide, N,N,N-trimethyl-N-(2-hydroxy-3-methacryloyloxypropyl)ammonium chloride, etc. may be used. Also, 2-hydroxyethyl(meth)acrylate, (meth)acrylamide, N-monomethylol(meth)acrylamide, N-dimethylol(meth) acrylamide, N-vinylpyrrolidone, N-vinylacetamide and polyoxyethylene glycol mono(meth)acrylate, etc. are useful.

Among these monomers, particularly preferable monomers are monomers having a nonionic functional group such as an N-substituted amide and an N,N-disubstituted amide. Specific examples thereof include a poly-N-vinylacetamide, poly-N-vinylpyrrolidone and N,N-dimethylamide.

Although the mechanism underlying of the effect exhibited by the hydrophilic graft-polymer chain prepared employing this method is not clear, it is considered that a hydrophilic graft-polymer bonded to the surface of a hydrophobic polymer at respective points has a phase separation structure between the hydrophilic groups and a hydrophobic region to constitute the base material at the surface, or the inside the base material made of a hydrophobic resin, whereby a portion having the hydrophilic group exists independently from the hydrophobic base material, making it possible to efficiently form a water passage, in combination with high mobility of the graft.

(3) A Method in Which a Hydrophobic Principal Polymer Having a Hydrophilic Graft Chain is Allowed to Crosslink:

This method is carried out by using a crosslinking agent, in which a polymer having a group reactive with a crosslinking agent in its molecule is used as the hydrophobic principal polymer that has a hydrophilic graft chain to thereby form a crosslinked structure. When this method is employed, the principal polymer having a desired hydrophilic graft chain is firmly fixed to the base material by crosslinking.

Specific examples of the method include a method in which a copolymer composed of a structural unit having a hydrophilic group, a structural unit having a group capable of forming a crosslinked structure, and a structural unit having an unsaturated double bond to participate in polymerization, such as a hydrophilic macromer/benzylmethacrylate/acrylic acid (weight ratio: 50/30/20) copolymer is used as a principal polymer, and crosslinking is effected by using a crosslinking agent such as difunctional diglycidyl compound.

Hydrophobic Polymer to Constitute Base Material

In the abrasive pad of the invention, the base material contributes as an abrasive layer. Description will now be given of the hydrophobic polymer (hereinafter, this resin is occasionally referred to as a matrix) that constitutes the hydrophobic base material.

As the hydrophobic polymer used for the base material in the invention, a desired hydrophobic polymer material may be employed as long as free radicals generate at the surface of the material. When it is exposed to a gas plasma, radical generating action or other means, energy is imparted thereto, and thereby creating an active point to effect binding of the graft-polymer.

As the hydrophobic polymer matrix, a polymer containing, as its major component, at least one resin selected from the thermoplastic resins, such as a polyvinyl chloride type resin, polyvinylidene chloride type resin, polystyrene type resin, acrylonitrile/styrene copolymer type resin, acrylonitrile/butadiene/styrene copolymer type resin, acrylonitrile/butadiene/methylmethacrylate copolymer type resin, polyamide type resin, methacryl type resin, polyolefin type resin, polyester type resin, polyacetal type resin, polycarbonate type resin, polyphenylene ether type resin, polyphenylene sulfide type resin, polysulfone type resin and cellulose acetate type resin or thermoset resins such as a phenol resin, urea resin, melamine resin, epoxy resin, urethane resin and polyimide resin may preferably be used. Not only a single resin, but also a mixture (including an alloying material) of these resins or copolymers containing these components may be used. Further, materials into which other graft chains have been introduced, and modified polymers, such as modified products, into which other functional groups have been introduced, may be used.

As the polymer to constitute the base material, polyolefin-type such as polyester (PE) and polypropylene (PP), or aryl-type such as polystyrene, diene-type polymers such as polybutadiene and polyisoprene, silicone-type polymers such as silicone rubber and fluorine-type polymers such as polytetrafluoroethylene or its copolymer are preferably used in view of strength and durability.

The base material may have an arbitrary shape and size. The base materials having complicated geometric form are preferably used from the viewpoint of increasing a surface area to provide a larger number of polymer graft chains.

The polymer base material itself may have a shape of a thin layer such as a film or sheet, rod, hollow-tube form, fiber form or thread form, and also be in a porous or non-porous structure. Further, the polymer base material may be a fabric or nonwoven fabric material made of these raw materials.

In order to make the polymer base material into these desired shapes, known molding methods such as extrusion molding, compression molding, injection molding, thermal molding or vacuum molding may be applied.

If the base material is made of nonwoven fabric or made into a porous structure, a graft-polymer chain having a hydrophilic group can exist inside of the structural body of the base material, and hence, an abrasive solution or abrasive particles contained in an abrasive solution can be maintained or supplied effectively.

A thickness of the abrasive pad is preferably from 0.2 to 30 mm, more preferably from 0.3 to 10 mm, and still more preferably from 0.5 to 3 mm, without any particular limitation.

If the thickness of the abrasive pad is too small, there arises a case where the effects of the invention are not sufficiently exerted, since when the abrasive pad is provided with a cushion layer which will be explained later, the characteristics of the cushion layer or the mechanical characteristics of an abrading disc positioned beneath the pad may appear more significantly than those of the abrasive pad itself. On the other hand, if the thickness is too large, the mechanical characteristics of the cushion layer and abrading disc can be scarcely reflected, which leads to reduced adaptability to a warped semiconductor substrate, thus failing to uniform flatness of the whole substrate.

When the base material of the abrasive pad according to the invention is made of nonwoven fabric or a porous material, an abrasive solution is supplied, maintained and discharged effectively through voids present in the fibers or in the porous material. However, when the base material is made of a solid layer, it is preferable to provide grooves or holes at the surface of the material for the purpose of supplying an abrasive solution to the abrasive surface, which is in contact with the surface of a working piece such as a semiconductor substrate, and thereby facilitating discharge of the abrasive solution therefrom. As the shape of the groove, various shapes such as a concentric circle form, spiral form, radial form and crosscut form may be preferably adopted. As to the sectional shape of the groove, grooves having a sectional shape such as a square form, triangular form, semicircular form may be preferably adopted. As regards a depth, a width and a pitch of the groove, although no particular limitation is imposed, the depth is preferably in the range of from 0.1 mm to the thickness of the abrasive layer, the width is preferably in the range of from 0.1 to 20 mm, and the pitch is preferably in the range of from 2 to 200 mm.

The holes may extend, or not extend over an entire depth of the abrasive layer. Although no particular limitation is imposed on the diameter and pitch of the holes, the diameter is preferably in the range of from 0.2 to 20 mm, and the pitch is preferably in the range of from 2 to 100 mm.

In the invention, the abrasive pad in a single abrasive layer form (abrasive pad of the invention) that is made of a hydrophobic polymer base material in which a graft-polymer chain having a hydrophilic group has been introduced into the surface may be used. In a preferred embodiment, the abrasive pad has a two-layer construction obtained by laminating a cushion layer with the lower part of the abrasive layer.

As the cushion layer used for the abrasive pad of the invention, nonwoven fabric that is impregnated with a resin such as a polyurethane, an elastomer such as rubber, a foam elastic material, a foam plastic, etc. may be adopted, without any particular limitation.

Specifically, a non-foam elastomer such as natural rubber, nitrile rubber, Neoprene (registered trademark) rubber, polybutadiene rubber, polyurethane rubber and silicon rubber are preferably used in view of elasticity. Also, nonwoven fabric impregnated with polyurethane (e.g., trade name: Suba400 manufactured by Rodel Company), which has currently widespread use, or the like is preferably used.

A thickness of the cushion layer is preferably in the range of from 0.1 to 100 mm, more preferably in the range of from 0.2 to 5 mm, and still more preferably in the range of from 0.5 to 2 mm. When the thickness is too small, there arises a tendency that the effect of imparting excellent flatness on the entire surface of a semiconductor substrate, due to the presence of the cushion layer, is not sufficiently obtained. In contrast, when the thickness is too large, flatness tends to be impaired locally.

The abrasive pad of the present invention is fixed to an abrading disc when it is used. In this case, it is important to settle the abrasive pad such that the cushion layer is prevented from sliding from the abrading disc during abrading operation, and that the abrasive layer is prevented from sliding from the cushion layer. There is no particular limitation to a method of fixing the abrading disc to the cushion layer. Conventionally known methods such as a fixing method using a double adhesive tape, a fixing method using an adhesive agent, and a method of fixing the cushion layer through suction from the abrading disc side may be adopted. No particular limitation is imposed on a method of fixing the cushion layer to the abrasive layer and, for example, a fixing method using a double adhesive tape or an adhesive agent may be adopted.

As the double adhesive tape or adhesive agent to be used when laminating the abrasive layer with the cushion layer, conventionally used products may be selected suitably. Specific examples thereof include acryl type adhesive transferring tapes having no support such as double adhesive tapes 463, 465 and 9204 (manufactured by Sumitomo 3M Ltd.), a double adhesive tape No. 591 (manufactured by Nitto Denko Corp.), double adhesive tapes made from a foam sheet as a support such as Y-4913 (manufactured by Sumitomo 3M Ltd.), and double adhesive tapes made from a soft vinyl chloride as a support such as 447DL (manufactured by Sumitomo 3M Ltd.).

In the invention, it is possible to exchange the abrasive pad by removing the abrasive pad from the cushion layer, with maintaining the conditions that the cushion layer is fixed to the abrading disc, in case where the abrasive pad should be replaced with a new pad, for the reason that the abrasive pad is deteriorated after repetitive abrading operation and desired abrasive effect is no longer exerted or the abrasive pad is broken down. Because the cushion layer has a sufficient durability than that of the abrasive pad itself, it is preferable to exchange only the abrasive pad in view of costs.

Description will now be given of a CMP method to abrade a semiconductor substrate by using the abrasive pad of the invention.

Using the abrasive pad of the invention, irregularities on an intra-layer insulating film and irregularities on a metal wire can be flattened in the presence of an abrasive solution containing, as the abrasive agent, abrasive particles such as a silica-type polishing agent, aluminum oxide-type polishing agent or cerium oxide-type polishing agent.

First, an abrading apparatus is fit up which is equipped with an abrasive head for fixing a substrate to be abraded, an abrading disc for settling the abrasive pad, and means of rotating the abrasive head or the abrading disc or the both. Then, the abrasive pad of the invention is fixed to the abrading disc of the abrading apparatus to make the abrasive layer to face the abrasive head.

The semiconductor substrate is fixed to the abrasive head by means of a vacuum chuck. The abrading disc is allowed to rotate in the same direction as that of the abrasive head in order to be pressed against the abrasive pad. At this time, an abrasive solution is supplied from a position to be able to reach a space between the abrasive pad and the semiconductor substrate. The abrasive pad of the invention is superior in surface hydrophilicity and water supplying passage can be secured by this structure. Thus, if the abrasive solution is supplied to contact with a part of the abrasive pad, the abrasive solution can be spread over the entire surface to be abraded. Further, when abrasive particles are contained in the solution, these particles are adsorbed to and held by a hydrophilic functional group, thereby providing effectively abrasive conditions.

The pressure applied on the abrasive pad is usually adjusted by controlling a force applied to the abrasive head. The pressure is preferably in the range of from 0.01 to 0.2 MPa, such that good flatness can be attained.

The abrasive pad of the invention may be subjected to surface roughening treatment in advance by using a dresser, namely, dressing for the purpose of enhancing abrasive characteristics, as desired, before the semiconductor substrate or the like is abraded.

The dresser means a wheel on which diamond abrasive grains are electro-deposited. Specific examples of the dresser include a dresser (model name: CMP-M, CMP-N or CMP-L) manufactured by Asahi Diamond Industrial Co., Ltd. The particle diameter of the diamond abrasive grains may be selected from a range of 10 μm to 400 μm. The pressed pressure of the dresser is optionally specified within a range of from 0.005 MPa to 0.2 MPa.

Further, after one or plural abrading operations are complete, the abrasive pad can be dressed using a dresser in order to stabilize an abrading speed. When dressing is carried out, surface roughness after the treatment preferably ranges from 2 to 20 μm, and more preferably ranges from 3 to 7 μm, in terms of central average roughness Ra. Also, ten-point average roughness Rz preferably ranges from 10 to 300 μm, and more preferably from 20 to 100 μm.

Dressing of the surface of the abrasive layer prior to abrading makes it possible to maintain good lubricating conditions between the semiconductor substrate and the abrasive layer via an abrasive grain slurry used as the abrasive agent, and also achieves a high abrading speed stably. The central average roughness Ra and the ten-point average roughness Rz can be measured using a tracer-type surface roughness measuring meter, as standardized in JIS B0651.

Since the abrasive pad of the invention has a hydrophilic graft chain to exhibit superior characteristics in supplying the abrasive solution to the surface of the substrate, dressing is not always necessary. However, since the introduced graft-polymer chain having the hydrophilic group is not adversely affected by the dressing treatment, this treatment may preferably be carried out to achieve a desired surface roughness on the pad surface.

EXAMPLES

The present invention will now be explained in more detail by way of the following examples, which, however, are not intended to be limiting of the invention.

Example 1

Polyethylene terephthalate nonwoven fabric (AXTAR, manufactured by Toray, METSUKE: 280 g/m$^2$) was impregnated with a varnish composed of 94 parts (solid content) by weight of a tetrabromobisphenol A-type epoxy resin (YDB-500, manufactured by Tohto Kasei Co., Ltd.) having an epoxy equivalent of 500, 13 parts (solid content) by weight of a cresol novolac-type epoxy resin (YDCN-220, manufactured by Tohto Kasei Co., Ltd.) having an epoxy equivalent of 220, 2.8 parts by weight of dicyandiamide as a hardener, 0.1 parts by weight of 2-ethyl-4-methylimidazole as a curing accelerator and 25 part by weight of N,N-dimethylformamide as a solvent. The resultant nonowoven fabric was dried with heating at 180° C., and cut into a size of 50 cm square. The cut fabric was sandwiched between metal plates and pressed at a temperature of 170° C., a pressure of 4 MPa for 20 minutes, to thereby prepare a base material film having a thickness of 1.2 mm and a resin content of 55% by mass.

An aqueous 20% by mass acrylic acid solution was prepared as a hydrophilic monomer solution, which was deaerated using nitrogen for 15 minutes. Then, this monomer solution was applied dropwise onto the base material film as obtained above, and Lumirror (manufactured by Toray Industries, Inc.) was laminated with the film via a homogenious monomer solution layer having a thickness of about 100 μm. The film was irradiated under the conditions of an acceleration voltage of 2.0 MV and electron-beam current of 1 mv using an electron accelerator (Cascade-type IEA-300-25-2, manufactured by RDI in USA) with maintaining the film in contact with the monomer solution layer for one minute. The irradiation dose was 200 kGy. After the irradiation, Lumirror acting as the cover film was peeled off, and an unreacted monomer and a produced homopolymer were washed with ethanol, after which the film was dried under vacuum for 1 hour at room temperature. As a result, a material was given in which a graft-polymer chain was introduced into the surface of a hydrophobic polymer, as well as into the surface of the nonwoven fabric used as the base material and into the surface of the fiber inside of the nonwoven fabric.

This nonwoven fabric material was cut into a circular shape having a diameter of 38 cm, and further grooves having a width of 2 mm and a depth of 0.5 mm were formed lattice-wise at a pitch width of 15 mm on the surface, to finally produce an abrasive pad.

The thus produced abrasive pad was laminated with "Suba 400" (manufactured by Rodel Co.) as a cushion layer using a double adhesive tape 442J (manufactured by Sumitomo 3M Ltd. (double adhesive tape using a polyester film as a support)), to finally obtain an abrasive pad laminate of Example 1.

Examples 2 to 4

Abrasive pads of Examples 2 to 4 were produced by carrying out polymerization, to introduce a graft-polymer chain, in the same manner as in Example 1, except that N-vinylacetamide, N-vinylpyrrolidone and N,N-dimethylacrylamide were respectively used in place of the hydrophilic monomer acrylic acid. The used hydrophilic monomer solutions were an aqueous 20% by mass solution that had been deaerated using nitrogen for 15 minutes. These abrasive pads were laminated with a cushion layer in a similar manner to Example 1, to thus obtain abrasive pad laminates of Examples 2 to 4.

The films, that had undergone grafting as obtained in the respective examples, were extracted with methanol for 72 hours to find the grafting amount of the graft-polymer chain introduced, from the weights of the film measured before and after the extraction. The graft ratios found from these weights in Examples 1 to 4 were 15%, 25%, 33% and 20%, respectively.

Comparative Example 1

Using a base material film prepared similarly to Example 1, an abrasive pad was produced in the same manner as in Example 1, except that a graft-polymer chain by way of a hydrophilic monomer was not introduced. The abrasive pad was laminated with a cushion layer in the same manner as in Example 1, to thus obtain an abrasive pad laminate of Comparative Example 1.

Example 5

Acrylonitrile-butadiene rubber in the form of pellets (Nippon Zeon Co., Ltd.) was molded into a resin plate of 1.2-mm-thick and 38-cm-diameter, using an injection press molding machine IP-1050 (Komatsu Manufacturing Co., Ltd.). Then, using acrylic acid, this base material was subjected to electron-ray grafting in the same manner as in Example 1, by which a graft-polymer chain having a hydrophilic group was introduced into the surface of the base material. The graft ratio was 5%. The grooves having 2 mm width and 0.5 mm depth were formed lattice-wise at a pitch width of 15 mm on the surface, to thereby produce an abrasive pad.

Then, the abrasive pad was laminated with a cushion layer using a double adhesive tape 442J (double adhesive tape using a polyester film as a support; manufactured by Sumitomo 3M Ltd.) in the same manner as in Example 1, to thus obtain an abrasive pad laminate of Example 6.

Comparative Example 2

5% by mass of a polyacrylic acid (290,000 Aldorich) was admixed with acrylonitrile-butadiene rubber in the form of pellets (Nippon Zeon Ltd.) to prepare a material in which a hydrophilic monomer had been introduced into the surface thereof. Lattice-like grooves were formed on the surface of the prepared material in the same manner as in Example 5 to produce an abrasive pad, which was then laminated with a cushion layer to thus obtain an abrasive pad laminate of Comparative Example 2.

Comparative Example 3

Using carboxy-modified acrylonitrile-butadiene rubber in the form of pellets (Nippon Zeon Ltd.), an abrasive pad laminate was obtained in the same manner as in Example 5. Incidentally, the polymer constituting the pellets had a hydrophilic group on its surface through carboxy modification.

Evaluation of Abrasive Pad: CMP Performed on Silicon Wafer with Oxide Film

Using a 15LE type abrading apparatus (diameter ϕ of the abrading disc: 38 cm; manufactured by Lapmaster Company), an abrading operation was performed on a 4-inch silicon wafer in 1 μm-thickness with a thermal oxide film, as a working piece. As the abrasive solution, an abrasive particle slurry ("CAB-O-SPERSE SC-1" manufactured by Cabot Co.) was used after dilution with ultra-pure water three times.

The wafer was laminated with a packing film (T/P120-41CF22SJ; manufactured by Rodel Company) and settled to the abrasive head. The abrasive pad laminates obtained in Examples 1 to 5 and Comparative Examples 1 to 3, respectively, were fixed to the abrading disc using double adhesive tape (Type 442J, manufactured by Sumitomo 3M Ltd.).

The abrasive pad was evaluated for abrading performances after the surface was dressed using a dresser (Model CMP-M; manufactured by Asahi Diamond Industrial Co., Ltd.). The dressing conditions were as follows: pressure: 400 g/cm$^2$, rotating speed of the abrasive head and abrading disc: 30 rpm, amount of ultra-pure water to be supplied: 10 ml/minute and dressing time: 5 minutes. After dressed, the surface of the abrasive pad was washed by using a nylon brush under an ultra-pure water stream, and then subjected to an abrading operation. The abrading conditions were as follows: pressure: 400 g/cm$^2$, rotating speed of the abrasive head and abrading disc: 50 rpm, amount of the abrasive slurry to be supplied: 100 ml/minute and abrading time: 5 minutes.

The wafer after having undergone abrasion was washed by using a cloth impregnated with polyvinyl alcohol under an ultra-pure water stream, after which water was removed from the surface of the wafer by blowing compressed air. The abrading speed was detected in the following manner. A thickness of the oxide film was measured at 196 points (lattice, 5 mm pitch, unmeasured in an area at a distance of 10 mm or less from the edge) on the surface of the wafer using a film thickness measuring meter (Ramda Ace VM-2000; manufactured by Dainippon Screen Mfg. Co., Ltd.) before and after the abrading operation to thereby find the abrading speed from averaged values of a difference in film thickness. The number of scratching found on the surface of the wafer after abrasion was counted using a digital microscope (VH6300, manufactured by KEYENCE Corporation) equipped with an automatic X-Y stage. Also, the number of remaining dust was counted by a dust detector (manufactured by Topcon). In case where the number of scratching was 10/wafer or less and the number of remaining dust was 250/wafer or less, the semiconductor substrate was judged to have high quality.

The results of the abrading speed, the number of scratching and the number of remaining dust are shown in Tables 1 and 2 below.

In addition, an oxide film with an irregular pattern was evaluated for CMP abrasion, by means of a global difference level as a function of abrading time. The global difference level after a 4 minute abrading operation was rated as follows: 0.2μ or less: ◎, 0.3μ or less: ○ and 0.3μ or more: ×. The results are shown in Tables 1 and 2.

TABLE 1

| | Example 1 | Example 2 | Example 3 | Example 4 | Comparative Example 1 |
|---|---|---|---|---|---|
| Abrading Speed (Å/minute) | 1,230 | 1,550 | 1,360 | 1,610 | 1,050 |
| Number of Scratching (number/wafer) | 10 | 2 | 1 | 2 | 1,100 |
| Number of Remaining Dust (number/wafer) | 200 | 110 | 135 | 110 | 500 |
| Global Flatness | ○ | ◎ | ◎ | ◎ | X |

TABLE 2

| | Example 5 | Comparative Example 2 | Comparative Example 3 |
|---|---|---|---|
| Abrading Speed (Å/minute) | 1,110 | 980 | 1,000 |
| Number of Scratching (number/wafer) | 1 | 135 | 500 |
| Number of Remaining Dust (number/wafer) | 150 | 600 | 2,000 |
| Global Flatness | ○ | Δ | X |

As is clear from the results shown in Tables 1 and 2, it is revealed that the abrasive pad of the invention, employed under a high abrading speed for production of a semiconductor chip, had low levels of scratching and remaining dust. It is also revealed that when used for flattening a semiconductor wafer (bare wafer and/or wafer with an oxide film) by abrading operation before irregularity processing, the abrasive pad was useful to flatten minute irregularities on the surface of the wafer itself, which is surface defects expressed as nano-topology.

It is also clarified as a result of global flattening, that the abrasive pad of the invention is useful when surface patterning using lithography or the like, followed by a CMP abrading operation, is carried out.

Specifically, a wafer having very high flatness can be obtained by applying the abrasive pad of the invention during manufacturing the semiconductor. It is also found that if the above steps are carried out using the above-described abrading apparatus relating to the invention, it is possible to provide excellent flatness and readily fulfill requirements for forming a multi-layer semiconductor chip, thereby achieving high integration and fine wiring formation.

As detailed above, the present invention provides an abrasive pad having reduced adhesion of dust to a surface of a material to be abraded, low levels of scratching and excellent flattening characteristics.

What is claimed is:

1. An abrasive pad for abrading a surface to be abraded in the presence of an abrasive solution, the abrasive pad comprising (a) a base material comprised of a hydrophobic polymer and (b) a graft-polymer chain, wherein the polymer chain has a hydrophilic group and is directly bound to a principal polymer constituting the hydrophobic base material only at one terminal of the polymer chain and the surface of the base material has a continuous hydrophilic region over the entire surface owing to a free terminal of the graft-polymer chain.

2. The abrasive pad according to claim 1, wherein the hydrophilic group of the graft-polymer chain is a nonionic hydrophilic group selected from the group consisting of hydrophilic groups having an N-monoalkyl substituted structure and hydrophilic groups having an N-dialkyl substituted amide group.

3. The abrasive pad according to claim 1, wherein an amount of the graft-polymer chain introduced into the base material is 10.0% to 150.0% in terms of graft ratio.

4. The abrasive pad according to claim 2, wherein an amount of the graft-polymer to be introduced into the base material is 10.0% to 150.0% in terms of graft ratio.

5. The abrasive pad according to claim 1, wherein the base material comprises a polymer selected from the group consisting of a polyolefin- type polymer, an aryl-type polymer, a diene-type polymer, a silicone-type polymer and a fluorine-type polymer.

6. The abrasive pad according to claim 1, wherein the graft-polymer chain having a hydrophilic group has a molecular weight Mw ranging from 500 to 5,000,000.

7. The abrasive pad according to claim 1, wherein the graft-polymer chain having a hydrophilic group has a molecular weight Mw ranging from 1,000 to 1,000,000.

8. The abrasive pad according to claim 1, wherein the graft-polymer chain having a hydrophilic group has a molecular weight Mw ranging from 2,000 to 500,000.

9. The abrasive pad according to claim 1, having a thickness of 0.2 to 30 mm.

10. The abrasive pad according to claim 1, having a thickness of 0.3 to 10 mm.

11. The abrasive pad according to claim 1, having a thickness of 0.5 to 3 mm.

12. The abrasive pad according to claim 1, further comprising a cushion layer on one face of the base material.

13. The abrasive pad according to claim 12, the cushion layer comprises a material selected from the group consisting of a nonwoven fabric impregnated with a resin, an elastomer, a foam elastic material and a foam plastic.

14. The abrasive pad according to claim 12, wherein the cushion layer has a thickness in the range of 0.1 to 100 mm.

15. The abrasive pad according to claim 12, wherein the cushion layer has a thickness in the range of 0.2 to 5 mm.

16. The abrasive pad according to claim 12, wherein the cushion layer has a thickness in the range of 0.5 to 2 mm.

17. The abrasive pad according to claim 1, wherein the graft-polymer chain is additionally present inside the base material.

* * * * *